United States Patent [19]

Cohen et al.

[11] 4,023,235

[45] May 17, 1977

[54] MULTIPURPOSE STRUCTURE FOR SUPPORTING DRAPERY TRACKS, VENETIAN BLINDS, OR THE LIKE

[75] Inventors: Seymour Cohen, Plainview; Norman Klar, Brooklyn; David Schwartz, Mineola, all of N.Y.

[73] Assignee: Master Recessed Systems, Inc., Farmingdale, N.Y.

[22] Filed: Mar. 11, 1976

[21] Appl. No.: 665,768

[52] U.S. Cl. ..... 16/94 D; 160/345; 16/96 D

[51] Int. Cl.[2] ..... A47H 1/04

[58] Field of Search ..... 16/94 D, 95 D, 87.4 R, 16/87.6 R, 96 D, 96 R, 95 R, 93 D; 160/345; 52/27, 39, 484, 487

[56] References Cited

UNITED STATES PATENTS

| | | | |
|---|---|---|---|
| 3,371,701 | 3/1968 | Toti | 16/96 D UX |
| 3,649,741 | 3/1972 | Fremont | 52/39 X |
| 3,678,636 | 7/1972 | Cohen | 52/484 X |
| 3,708,927 | 1/1973 | Cohen | 160/345 X |
| 3,710,530 | 1/1973 | Valtonen | 52/484 X |
| 3,715,776 | 2/1973 | Tanaka | 16/96 D X |

FOREIGN PATENTS OR APPLICATIONS

| | | | |
|---|---|---|---|
| 430,144 | 8/1967 | Switzerland | 52/27 |

*Primary Examiner*—Andrew V. Kundrat
*Attorney, Agent, or Firm*—Steinberg & Blake

[57] ABSTRACT

For the purpose of supporting drapery tracks, Venetian blinds, or the like, there is provided an elongated channel having opposed side walls interconnected by a transverse wall which when the channel is in an operative position forms a top wall from which the opposed side walls extend downwardly. The channel has in its operative position an open bottom. A number of ribs extend inwardly from the inner surfaces of each of the side walls, these ribs serving to support items such as a drapery track, when the latter is situated within the channel, blind locks on which part of a Venetian blind with horizontal slats may be supported, or blind locks for determining the location of part of a Venetian blind which has vertical slats situated beneath the channel. Thus, the same channel may be used in connection with supporting different types of articles.

14 Claims, 6 Drawing Figures

MULTIPURPOSE STRUCTURE FOR SUPPORTING DRAPERY TRACKS, VENETIAN BLINDS, OR THE LIKE

BACKGROUND OF THE INVENTION

The present invention relates to devices used in connection with the support of window coverings of different types such as draperies or Venetian blinds.

Up to the present time, special carriers are required in connection with window coverings of different types. For example if a drapery is to be situated in front of a window, then a particular type of channel is required to carry a drapery track. If a Venetian blind with horizontal slats is to be situated in front of a window, then another type of carrier channel is required to support such a Venetian blind. On the other hand, if a Venetian blind with vertical slats is to be situated in front of a window, then still a third type of channel is required in connection with supporting the upper part of such a Venetian blind.

This requirement of different type of channel structures according to the particular type of window covering to be used represents a great inconvenience. In the first place, when the structure is initially set up, it is necessary to first predetermine the type of window covering which is to be used. In the second place, different types of supporting channels are required as set forth above. In the third place, when one type of supporting channel is placed in position for supporting one type of window covering, then if the window covering is to be changed, the supporting channel must also be changed. These conditions create great inconveniences as well as high costs and an undesirable lack of flexibility in selecting or changing a given type of window covering.

Moreover, irrespective of the particular type of supporting channel conventionally used for supporting a particular type of window covering, the mounting of the supporting channel in position is costly and inconvenient.

Moreover, depending upon the available building structure to which the supporting channel is to be connected so as to be supported thereby, different structures are required for the supporting structure. For example where the channel is to be connected directly to a building structure such as a beam or the like, one type of construction is required, whereas if the building structure is such the channel is to be hung from a beam, connected to a wall bracket, or the like, then different constructions are required.

Thus, all of these variables in connection with the particular type of window covering which is to be used and the particular type of building structure which is encountered give rise to the necessity at the present time of providing a large variety of structures which must be carefully selected, which result in increasing costs in the manufacture of the different types of structures as well as in the different types of mountings required therefor.

SUMMARY OF THE INVENTION

It is accordingly a primary obect of the present invention to provide a structure which will avoid the above drawbacks.

In particular, it is an object of the present invention to provide a channel structure which can serve a multiplicity of purposes, so that the same channel structure can be used for different types of window coverings.

Also, it is an obect of the present invention to provide a channel structure which can be readily mounted in an opeative position.

Furthermore, it is an obect of the present invention to provide a channel structure which lends itself to mounting on different types of building structures.

Furthermore, it is an object of the present invention to provide for use with a channel structure a mounting bracket which is of particular convenience and reliability.

In addition, it is an object of the present invention to provide for use with a channel structure of the above type of blind lock structure which is simple and at the same time conveniently assembled with other components.

According to the invention, the channel has a pair of opposed side walls and a transverse wall extending between and interconnected with the side walls, this transverse wall forming a top wall of the channel when it is in an operative position, with the side walls extending downwardly from the top wall in the operative position of the channel. The channel when in its operative position has an open bottom beneath the top wall. A plurality of ribs are integral with each side wall and project inwardly from and inner surface thereof, these ribs forming at the inner surfaces of the side walls pairs of ribs which are respectively situated in common planes but at different elevations. The lowermost ribs are adapted to form at least part of a support for a drapery track with additional upper ribs being provided also for this purpose. In addition, a plurality of upper ribs are provided nearer to the top wall than the lowermost ribs for serving a purpose such as supporting blind locks which will determine the position of part of a Venetian blind mechanism within the channel, particularly a Venetian blind mechanism forming part of a Venetian blind which has vertical slats. In the case of a Venetian blind which has horizontal slats, blind locks are situated in grooves defined between the lowermost pairs of ribs for supporting in the channel the mechanism which is situated above the horizontal slats of the Venetian blind. A horizontal wall is fixed to and projects from a lower edge of one of the side walls of the channel and carries a connecting means by which the channel can be supported in cantilever fashion from a mounting bracket of the invention. In addition, an additional connecting means is provided on an additional horizontal wall projecting from a lower edge of the other side wall of the channel for supporting the channel from a T-bar type of support which suspended by cables from a beam.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
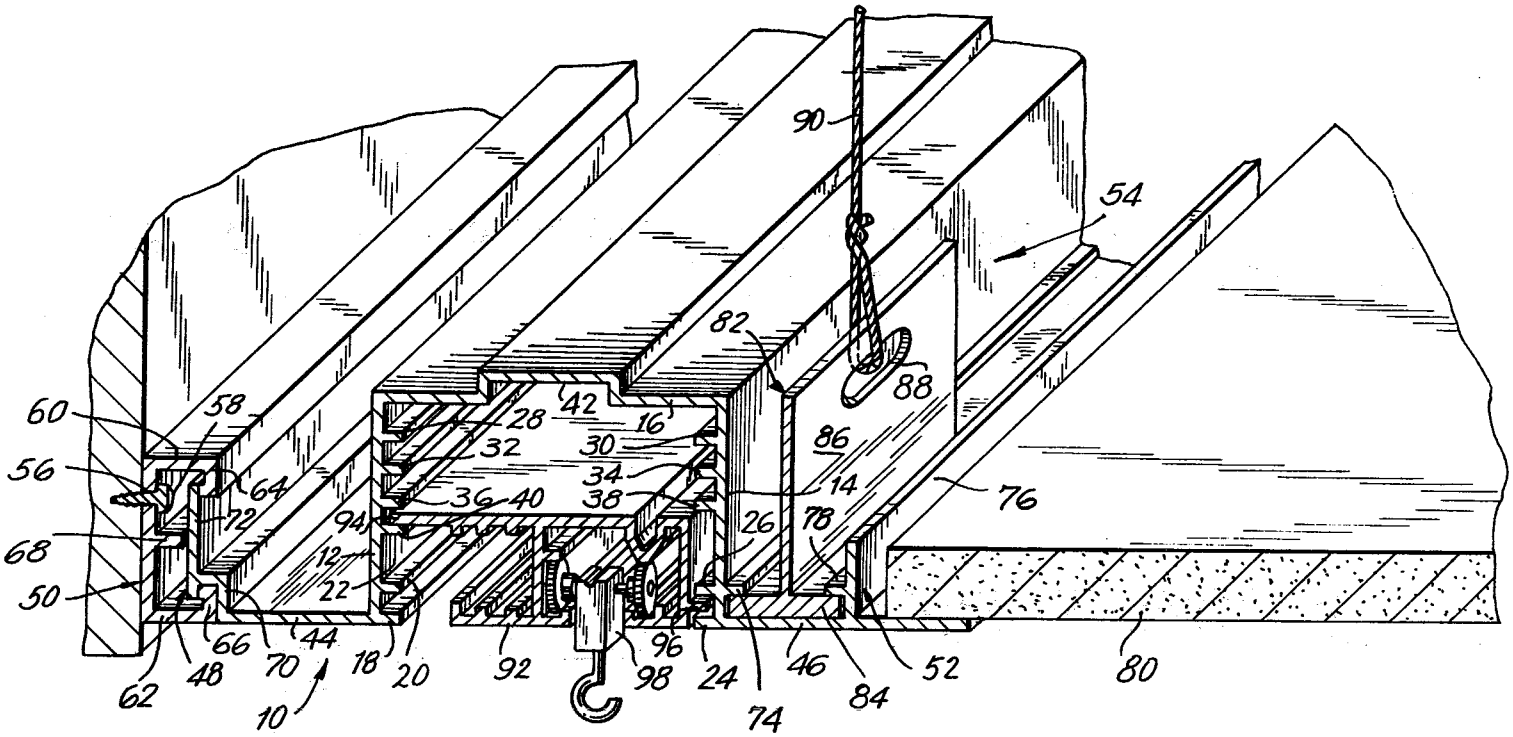
FIG. 1 is a partly sectional perspective illustration of a structure according to the invention shown in FIG. 1 supporting a drapery track.

Referring now to FIG. 1, there is shown therein a channel 10 of the invention in an operative position. This channel 10 has a pair of opposed side walls 12 and 14 which are interconnected by a transverse wall 16 which forms a top wall of the channel 10 when the latter is in the operative position shown in FIG. 1. The side walls 12 and 14 are respectively formed integrally with a plurality of ribs which project inwardly from inner surfaces of the side walls 12 and 14. Thus, it will be seen that these ribs include a lowermost pair of ribs 18 and 20 projecting inwardly from an inner surface 22 of the side wall 12. In a similar manner a lowermost pair of ribs 24 and 26 project inwardly from the inner surface of the side wall 14. The ribs 18 and 24 are situated in a common plane while the ribs 20 and 26 are situated in a common plane. Adjacent the top wall 16, there are a pair of ribs 28 and 30 in a common plane projecting inwardly from the inner surfaces of the side walls 12 and 14, and beneath the ribs 28 and 30 there are a similar pair of ribs 32 and 34 followed by the next lower ribs 36 and 38. Thus, the ribs 32 and 34 are situated in a common plane while the ribs 36 and 38 are also situated in a common plane. Thus, the pair of ribs 28, 30, the pair of ribs 32, 34, and the pair of ribs 36, 38 form pluralities of pairs of ribs situated at an elevation substantially higher than the lowermost pairs of ribs 18, 24 and 20, 26. Furthermore, there is one additional rib 40 situated beneath the rib 36 and above the rib 20. Of course all of these ribs are horizontal when the channel 10 is in an operative position. The successive pairs of ribs define between themselves grooves for a purpose referred to below. Also, for a purpose referred to below the top wall 16 has an intermediate raised portion 42 which has a downwardly directed hollow interior as illustrated in FIG. 1.

The opposed side walls 12 and 14 of the channel 10 terminate in lower edges from which horizontal walls 44 and 46 project laterally, as illustrated in FIG. 1. Thus, these horizontal walls 44 and 46 respectively form continuations of and are situated in the same plane as the lowermost ribs 18 and 24. The horizontal wall 44 is integrally formed with a connecting means 48 for connecting the channel 10 to a supporting structure formed by a mounting bracket 50 described below. The horizontal wall 46 also carries a connecting means 52 described in greater detail below, this connecting means 52 serving to connect the channel 10 to a supporting structure 54 described in greater detail below.

The mounting bracket 50 has an outer vertical wall 56 adapted to be fixed, by screws 58 or the like, for example, to a stationary building structure such as the framing structure extending along the top of a window. The mounting bracket 50 includes an upper wall 60 and a lower wall 62 respectively projecting from the outer wall 56 toward the channel 10. The upper wall 60 terminates in a downwardly extending rib 64 of substantially L-shaped cross section, as illustrated, and the lower wall 62 terminates in an upwardly extending vertical rib 66 which is also of substantially L-shaped configuration, as illustrated, so that at their edges which are nearest to each other, the ribs 64 and 66 project slightly back toward the outer wall 56. In addition, between its upper and lower wall 60 and 62 the bracket 50 includes an interior intermediate rib 68 formed integrally with the outer wall 56 and projecting therefrom toward the space between the ribs 64 and 66.

The connecting means 48 which is fixed to the horizontal wall 44 includes a substantially U-shaped portion 70 extending from a free edge region of the horizontal wall 44 and having a downwardly directed interior for receiving the free edge portion of the rib 66. In addition, the connecting means 48 includes an end wall 72 which forms an extension of the outer leg of the U-shaped portion 70 and extends therefrom upwardly into engagement with an inner surface of the lower free edge region of the upper rib 64.

Thus, it will be seen that by way of this construction of the mounting bracket 50 of the invention and the connecting means 48 it is a simple matter to mount the channel 10 on the mounting bracket 50. This procedure involves only tilting the channel 10 in a counterclockwise direction from the position thereof shown in FIG. 1 so that the upper edge of the end wall 72 can readily be situated behind the upper rib 64 of the mounting bracket 50. Then the channel 10 can be lowered so that the free edge of the lower rib 66 of the mounting bracket 50 will be received in the interior of the U-shaped portion 70 of the connecting means 48. The interior rib 68 serves not only to strengthen the mounting bracket 50 but also to guide the end wall 72 during mounting of the channel 10 on the bracket 50, with this rib 68 also serving to limit any inward play of the channel toward the interior of the mounting bracket 50. Any outward movement is of course limited by the ribs 64 and 66. In addition, the rib 68 defines with the upper wall 60 a space for receiving the head of the fastening members 58 which fasten the mounting bracket 50 to the stationary building structure. Thus, it will be seen that in this convenient manner it is possible quickly and easily to mount the channel 10 on the mounting bracket 50 so that the channel 10 is supported in cantilever fashion from the bracket 50. It will be noted that when mounted on the bracket 50 the horizontal wall 44 is situated at the same elevation as and forms substantially an extension of the lower wall 62 of the mounting bracket 50.

The connecting means 52 which cooperates with the other horizontal wall 46, projecting laterally from the lower edge of the side wall 14 which is opposite to the side wall 12 of the channel 10 includes a rib 74 integral with and projecting from an outer surface of the side wall 14. In addition, the connecting means 52 includes a vertical wall 76 integral with and projecting upwardly from the horizontal wall 46, and a rib 78 integral with the wall 76 and projecting therefrom toward the rib 74 while being in the same plane as the latter. It will be seen that the horizontal wall 46 projects outwardly beyond the vertical wall 76 of the connecting means 52 and thus provides a structure for supporting part of a plurality of ceiling tiles 80.

The supporting structure to which the connecting means 52 connects the channel 10 takes the form of a plurality of T-bars 82 having the inverted T-shaped configuration illustrated in FIG. 1. The T-bars 82 have lower horizontal walls 84 received at its outer edges in grooves defined between the ribs 74 and 78 and the wall 46. These T-bars 82 are readily slipped into these grooves so as to be connected with the channel 10. In addition, where a pair of channels 10 abut one against the next it is preferred to have a T-bar 82 extending across the abutting ends of such a pair of channels 10. The vertical wall 86 of each T-bar 82 is formed with a plurality of slots 88 through which wires or cables 90 are looped in a manner illustrated in FIG. 1. These wires or cables 90 are connected in a known way at their top ends to beams of the building structure, so that in this way the supporting structure 54 serves to support the channel 10 at a side thereof which is opposite from the side carried by the mounting bracket 50.

If it should happen that the building structure is of the type which requires the channel 10 to be connected directly to a supporting beam, for example, then the raised portion 42 can be used for this purpose. Thus it is a simple matter to insert fastening screws, which may be of the self-threading type, for example, directly through the uppermost wall portion of the raised portion 42 into a horizontal beam of a building structure, so that in this way the channel 10 can be directly connected with such a beam. The downwardly directed hollow interior of the raised portion 42 of the top wall 16 serves to accommodate heads of such fastening screws so that these heads will not extend into the space between the opposed side walls 12 and 14.

It is to be noted that the entire channel 10 including not only the side walls 12 and 14, the top wall 16, and the ribs projecting from the inner surfaces of the side walls 12 and 14, but also the horizontal walls 44 and 46 as well as the connecting means 48 and 52 are all in the form of a single unitary extrusion which after it is extruded is cut into suitable lengths for convenient handling and shipping. These extrusions may be made of any suitable metal, for example, such as aluminum, if desired. Th same is true of the mounting bracket 50 which is in th form of a single unitary elongated extrusion which may be made of the same material as the channel 10. While the mounting bracket 50 will be coextensive with the channel 10 so as to provide a more than adequate support therefore, the T-bars 82 which form the supporting structures 54 need only be a few inches in length and can be distributed along the horizontal wall 46 beneath the ribs 74 and 78 at suitable spaced locations.

Assuming that a channel 10 of the invention has been mounted in the manner described above, then this structure of the invention can be used for a number of different types of window coverings. For example if a drapery is to be used in front of the window, then it is possible very quickly and easily to situate in the channel 10 a drapery track 92 which in itself is of a well known construction. This drapery track 92 has a pair of opposed upper and lower ribs 94 and 96. In order to mount the drapery track 92 in the channel 10 it is only necessary to situate the rib 94 in the groove defined between the ribs 36 and 40 and then to snap the rib 96 into the groove defined between the ribs 24 and 26. Through this simple expedient it is possible quickly and easily to mount the drapery track 92 in the position illustrated in FIG. 1. This drapery track carries in a well known manner hangars 98 capable of rolling along the drapery track in the manner apparent from FIG. 1.

Figure 2:
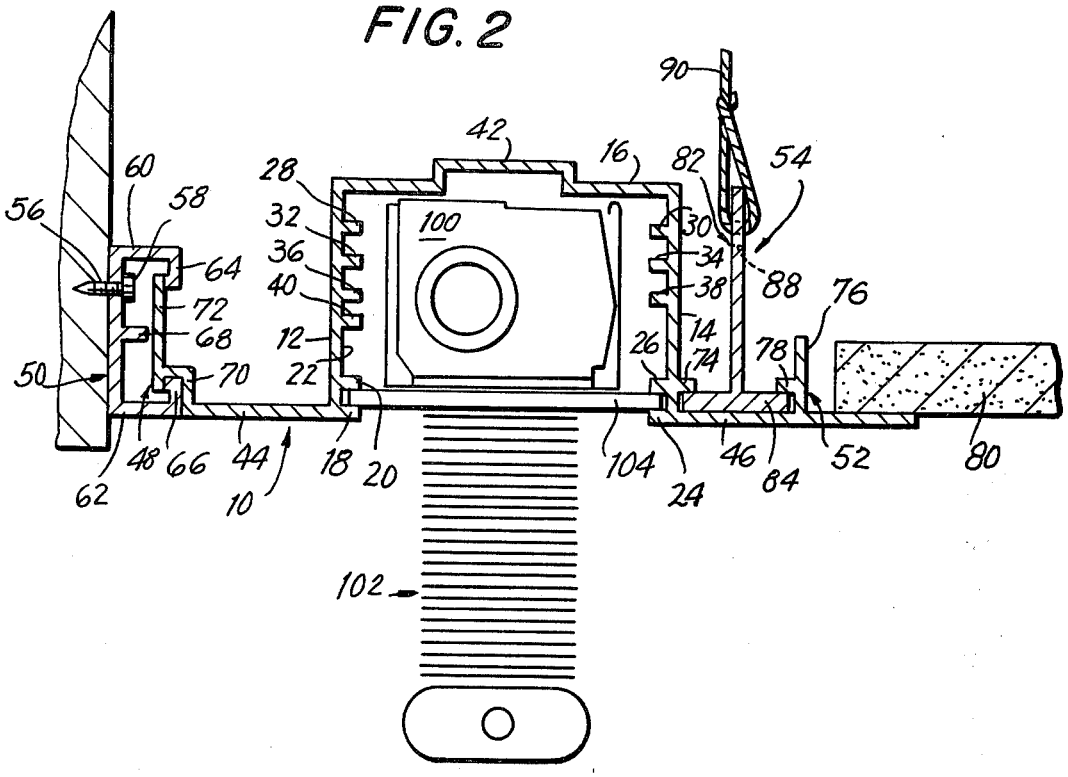
FIG. 2 is a transverse section illustrating how the structure of FIG. 1 is used in connection with a Venetian blind having horizontal slats.

If, instead of mounting a drapery track in the channel 10 of the invention it is desired instead to use the channel of the invention to support a Venetian blind with horizontal slats, then it is possible to mount such a Venetian blind in the channel in the manner shown most clearly in FIG. 2. For this purpose the upper elongated housing 100 for the mechanism of the Venetian blind 102 which has the horizontal slats illustrated in FIG. 2 is situated in the interior of the channel 10 between the opposed side walls 12 and 14 thereof. The blind locks 104 are situated beneath the housing 100 of the mechanism of the Venetian blind 102, these blind locks 104 being distributed at suitable locations along the channel 10 in the manner shown in FIG. 2 so as to support the housing 100 for the mechanism of Venetial blind 102.

Figure 4:
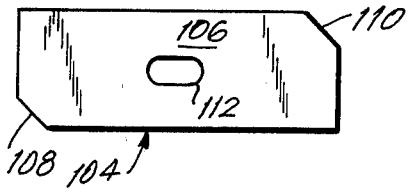
FIG. 4 is an illustration of a blind lock of the invention.

Referring to FIG. 4, each blind lock 104 is in the form of a flat plate 106 made of any suitable metal, for example. The plate 106 is of the rectangular configuration illustrated in FIG. 4, except that a pair of diagonally opposed corners are bevelled as illustrated so as to provide at these corners the inclined edges 108 and 110. At a central portion the plate 106 is formed with an elongated slot 112 capable of receiving the tip of a screwdriver.

Figure 5:
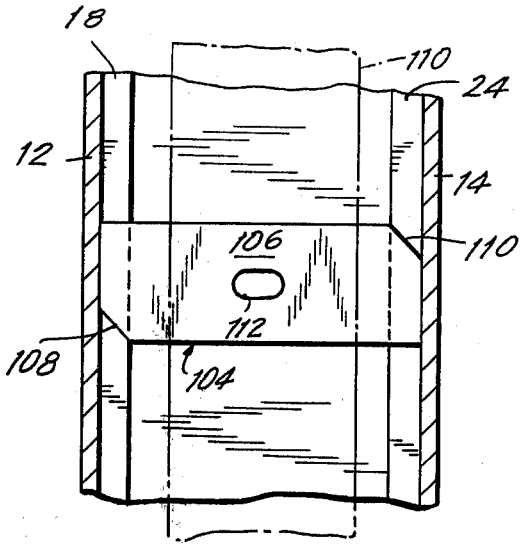
FIG. 5 is a fragmentary sectional plan view illustrating how the blind lock is supported in the channel.
Figure 6:
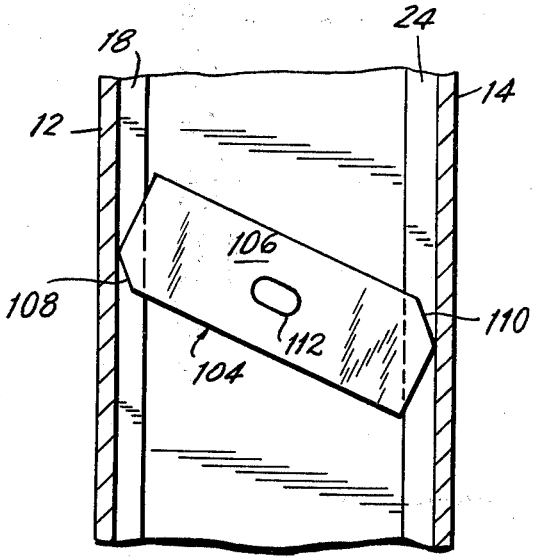
FIG. 6 illustrates how the blind lock is moved into or out of the position shown in FIG. 5.

One of the plurality of blind locks 104 is shown in FIG. 5 situated on the pair of lowermost ribs 18 and 24 with the housing 100 of the Venetian blind 102 being shown in phantom lines in FIG. 5. In order to situate the blind lock 104 in the position shown in FIG. 5 this blind lock 104 is first turned at an angular position displaced clockwise from the position of the blind lock illustrated in FIG. 5 so that the bevelled edges 108 and 110 can easily pass between the inner edges of the ribs 18 and 24. Then the blind lock 104 is turned in a counterclockwise direction toward the position shown in FIG. 5 so as to situate parts of the opposed end of the blind lock in the spaces above the ribs 18 and 24 between the latter and the ribs 20 and 26. It will be possible manually to turn the blind lock 104 at this time to a position as illustrated in FIG. 6 where ends of the edges 108 and 110 engage the side walls 12 and 14. Now, with the tip of the screwdriver in the slot 112 it is a simple matter to turn the screwdriver so as to apply to the plate 106 a twist with a force sufficient to cause the ends of the edges 108 and 110 which engage the walls 12 and 14 to turn with respect thereto, while the plate 106 is turned in a counterclockwise direction from the position of FIG. 6 toward the position of FIG. 5. Due to the springy nature of the extrusion which forms the channel 10, the side walls 12 and 14 will yield in a springy manner apart from each other sufficiently to permit the blind lock to turn readily from the position of FIG. 6 to the position of FIG. 5, and in fact in its final position the opposed end edges of the blind lock may press against the walls 12 and 14 providing a secure connection for each blind lock in this way.

Thus, in the case of a Venetian blind with horizontal slats as shown in FIG. 2, it is only necessary to place the mechanism housing 100 within the channel 10 between the walls 12 and 14 and then to twist a number of blind locks 104 into the position indicated in FIG. 2 at suitable locations along the housing 100 to support the latter securely in a manner apparent for FIG. 2. Of course it is a simple matter to remove these blind locks through the reverse procedures described above and shown in FIGS. 5 and 6. Thus should it be desired to remove a Venetian blind as shown in FIG. 2 and replace it, for example, with a drapery track as shown in FIG. 1, then such a replacement can be easily carried out as is apparent from the above description.

Figure 3:
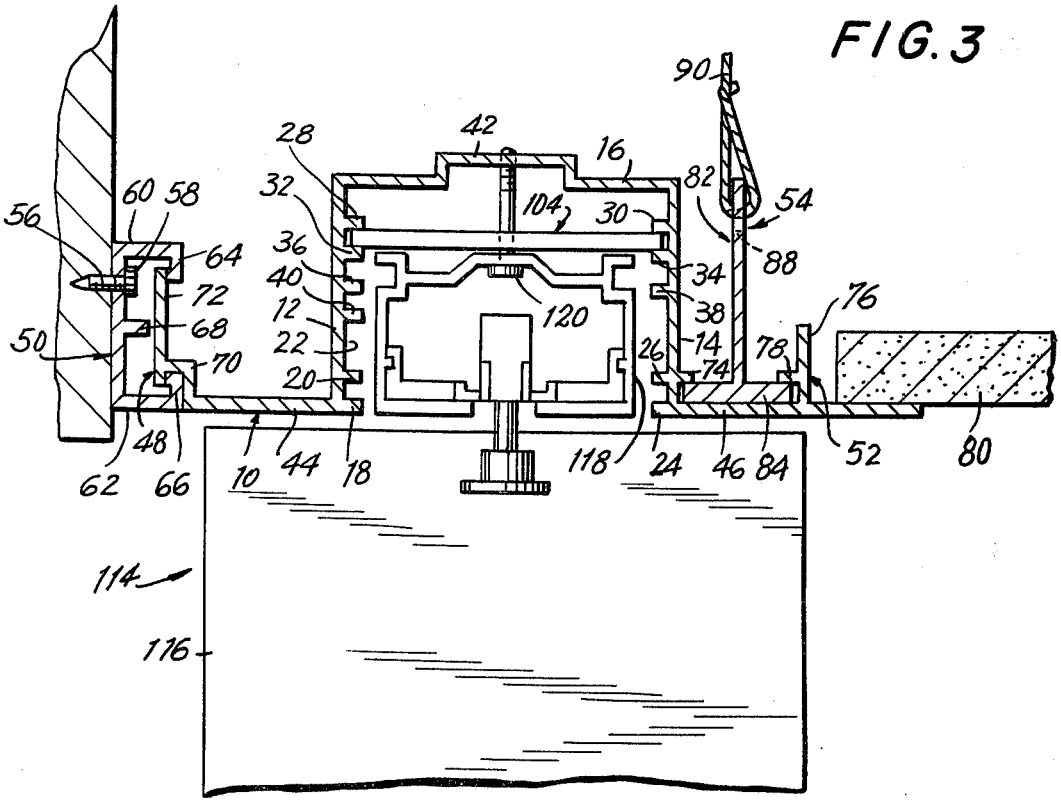
FIG. 3 is a transverse section illustrating how the structure of FIG. 1 is used in connection with a Venetian blind having vertical slats.

In the event that it is desired to use the channel 10 of the invention in connection with a Venetian blind 114 having vertical slats 116, as illustrated in FIG. 3, then a number of blind locks 104 are situated, in the example shown in FIG. 3, within the grooves defined on the one hand between the ribs 28 and 32 and on the other hand between the ribs 30 and 34. These blind locks 104 are situated at suitable space locations along these grooves and are situated in the position indicated in FIG. 3 through the procedures described above in connection with FIGS. 5 and 6. With these blind locks thus positioned in the manner shown in FIG. 3, the upper mechanism 118 of the Venetian blind 114 is situated in the channel 10 between the walls 12 and 14 thereof. Then at suitable spaces between the horizontally movable components of the Venetian blind 114 screws 120, of the self-threading type, for example, are driven up through the top wall of the housing of the Venetian blind mechanism, these screws being long enough to thread themselves into the uppermost wall portion of the channel 10 in the manner illustrated in FIG. 3. The screws 120 need not pass through the blind locks 104, although no harm is done if the screws are also driven through the blind locks 104 in FIG. 3. The purpose of the blind locks 104 is to determine the elevation of the mechanism 118 for the arrangement shown in FIG. 3. The screws 120 serve directly to support the mechanism 118 from the top wall of the channel. Thus, a suitable number of screws 120 will be distributed along the mechanism 118 and will serve to support the latter in a manner described above. In this case also should it be desired to remove a vertical Venetian blind and replace it by a horizontal Venetian blind or a drapery track, then it is a simple matter to remove the screws 120 and to follow the procedures set forth above in connection with FIGS. 1 and 2 for the purpose of using the same channel either for a drapery track or for a Venetian blind having horizontal slats.

It is thus apparent that the above-described structure of the invention provides a number of different purpose. The same channel structure with the same mounting structure therefor can be used for a number of different types of window coverings. It is to be noted that any of the internal ribs of the channel 10 which do not happen to be used in connection with blind locks or a drapery track are nevertheless of value inasmuch as they serve to strengthen the side walls 12 and 14. For some purposes it may be desirable to situate blind locks just below the ribs 32 and 34 in the grooves defined between the latter and the ribs 36 and 38. Also it is possible to situate blind locks, if desired, above the ribs 28 and 30 in the grooves defined between the latter and the top wall of the channel. Thus it is clear that a highly flexible structure serving a multiplicity of purposes is provided. In this way it becomes unnecessary to have on hand a number of different types of channels inasmuch as the same channel structure will serve all purposes which are encountered in practice. This one channel structure of the invention when mounted in position can be used not only to mount any desired type of window covering in position but also the same channel structure will be used if it should be desired at any time to change from one type of window covering to another type of window covering.

It is to be noted in connection with FIG. 3, that any tendency of the channel of the invention to tilt in a counterclockwise direction during driving of the screws 120 into the top wall of the channel will be opposed by engagement of the end wall 72 with the rib 68, so that in the event that the weight of the channel itself is not sufficient to resist the force driving the screw 120 through the top wall of the channel, the rib 68 cooperates with the end wall 72 to prevent undesired lifting or tilting of the channel.

Thus, an exceedingly secure and strong structure is provided for supporting any desired type of window covering.

What is claimed is:

1. For use in the support of drapery tracks, Venetian blinds, or the like, an elongated channel having a pair of opposed side walls, which respectively have inner surfaces directed toward each other, and a transverse wall extending between and interconnecting said side walls and forming a top wall from which said side walls extend downwardly when the channel is in an operative position, said channel having an open bottom situated beneath said top wall thereof in said operative position of said channel, and said channel including a plurality of interior ribs extending longitudinally of said channel and fixed to said side walls thereof while extending inwardly from said inner surfaces of said side walls, said ribs at each of said side walls being situated at different elevations when the channel is in said operative position, and said ribs including a plurality of pairs of ribs with the ribs of each pair being respectively situated at said opposed side walls in a common plane, said pairs of ribs including in said operative position of said channel at least two lowermost pairs of ribs, for use in at least the partial support of a drapery track or in the support of blind locks which in turn support one type of Venetian blind, while also including a plurality of pairs of ribs situated higher than said lowermost pairs, closer to said top wall and adapted to be used in connection with another type of Venetian blind, said opposed side walls of said channel having in said operative position of said channel lower edges distant from said top wall, and a pair of horizontal walls fixed to said opposed side walls at said lower edges thereof and projecting laterally from said lower edges, said horizontal walls respectively carrying connecting means extending upwardly from said horizontal walls for connecting said channel with a pair of supporting structures which serve to carry said channel and which engage said connecting means at elevations higher than said horizontal walls in said operative position of said channel.

2. The combination of claim 1 and wherein a plurality of blind locks are situated in grooves defined between said lowermost pairs of ribs for supporting in said channel part of a Venetian blind which has horizontal slats situated beneath said channel.

3. The combination of claim 1 and wherein a plurality of blind locks are situated in grooves defined between two of said pairs of said plurality of pairs of ribs situated higher then said lowermost pairs for determining the location of part of a Venetian blind which has a vertical slats situated beneath said channel.

4. The combination of claim 1 and wherein a pair of adjacent ribs at one of said side walls and a pair of adjacent ribs at the other of said side walls respectively situated at the same elevation as said first mentioned pair of adjacent ribs defined between themselves a pair of grooves, and a plurality of blind locks each having opposed ends situated in said pair of grooves for participating in the location of part of a Venetian blind in said channel with slats of the Venetian blind situated beneath said channel.

5. The combination of claim 1 and wherein said top wall has between said opposed side walls of said channel a raised intermediate portion having a downwardly directed hollow interior and including an uppermost part of said top wall which if necessary can be directly connected to a building structure.

6. For use in the support of drapery tracks, Venetian blinds, or the like, an elongated channel having a pair of opposed side walls, which respectively have inner surfaces directed toward each other, and a transverse wall extending between and interconnecting said side walls and forming a top wall from which said side walls extend downwardly when the channel is in an operative position, said channel having an open bottom situated beneath said top wall thereof in said operative position of said channel, and said channel including a plurality of interior ribs extending longitudinally of said channel and fixed to said side walls thereof while extending inwardly from said inner surfaces of said side walls, said ribs at each of said side walls being situated at different elevations when the channel is in said operative position, and said ribs including a plurality of pairs of ribs with the ribs of each pair being respectively situated at said opposed side walls in a common plane, said pairs of ribs including in said operative position of said channel at least two lowermost pairs of ribs, for use in at least the partial support of a drapery track or in the support of blind locks which in turn support one type of Venetian blind, while also including a plurality of pairs of ribs situated higher than said lowermost pairs, closer to said top wall and adapted to be used in connection with another type of Ventian blind, a pair of adjacent ribs at one of said side walls and a pair of adjacent ribs at the other of said side walls respectively situated at the same elevation as said first-mentioned pair of adjacent ribs defining between themselves a pair of grooves, and a plurality of blind locks each having opposed ends situated in said pair of grooves for participating in the location of a part of a Venetian blind in said channel with slats of the Venetian blind situated beneath said channel, each of said blind locks including an elongated plate of substantially rectangular cross section having diagonally opposed bevelled corners for facilitating introduction of said plate at the opposed ends thereof into said grooves.

7. The combination of claim 6 and wherein said plate is formed at a substantially central portion thereof with an elongated cutout for receiving the tip of a screwdriver to be used in connection with inserting the plate into said grooves.

8. For use in the support of drapery tracks, Venetian blinds, or the like, a elongated channel having a pair of opposed side walls, which respectively have inner surfaces directed toward each other, and a transverse wall extending between and interconnecting said side walls and forming a top wall from which said side walls extend downwardly when the channel is in an operative position, said channel having an open bottom situated beneath said top wall thereof in said operative position of said channel, and said channel including a plurality of interior ribs extending longitudinally of said channel and fixed to said side walls thereof while extending inwardly from said inner surfaces of said side walls, said ribs at each of said side walls being situated at different elevations when the channel is in said operative position, and said ribs including a plurality of pairs of ribs with the ribs of each pair being respectively situated at said opposed side walls in a common plane, said pairs of ribs including in said operative position of said channel at least two lowermost pairs of ribs, for use in at least the partial support of a drapery track or in the support of blind locks which in turn support one type of Venetian blind, while also including a plurality of pairs of ribs situated higher than said lowermost pairs, closer to said top wall and adapted to be used in connection with another type of Venetian blind, said opposed side walls of said channel having in said operative position of said channel lower edges distant from said top wall, and a pair of horizontal walls fixed to said opposed side walls at said lower edges thereof and projecting laterally from said lower edges, said horizontal walls respectively carrying connecting means for connecting said channel with a pair of supporting structures which serve to carry said channel, a mounting bracket forming one of said supporting structures, said mounting bracket having an outer wall adapted to be mounted at the same elevation as said channel on a stationary building structure and said mounting bracket including upper and lower walls extending inwardly from said outer wall toward said channel with said lower wall of said mounting bracket situated at the same elevation as one of said horizontal walls which project from a lower edge of a side wall of said channel, and said upper and lower walls of said mounting bracket terminating in substantially vertical ribs which project toward each other downwardly from said upper wall and upwardly from said lower wall of said mounting bracket, said one horizontal wall of said channel having adjacent said substantially vertical rib projecting upwardly from said lower wall of said mounting bracket a substantially U-shaped portion the interior of which is directed downwardly and receives a free edge of said substantially vertical rib which extends upwardly from said lower wall of said mounting bracket, and an end wall fixed with said substantially U-shaped portion, and forming an extension thereof in said mounting bracket, said end wall extending upwardly from said substantially U-shaped portion and engaging an inner surface of the rib which projects downwardly from said upper wall of said mounting bracket, said substantially U-shaped portion and end wall forming the connecting means with said one horizontal wall and being connectable with said mounting bracket when said channel is first tilted to situate said end wall in said channel with said free edge of said rib projecting upwardly from said lower mounting bracket wall received in said U-shaped portion so that an upper edge region of said end wall engage the rib projecting downwardly from said upper mounting wall to connect said channel to said mounting bracket to be supported thereby in substantially cantilever fashion.

9. The combination of claim 8 and wherein said mounting bracket has fixed with said outer wall thereof at an inner surface of said outer wall substantially midway between said upper and lower walls of said mounting bracket an internal rib projecting from said outer wall toward a space defined between said substantially vertical ribs of said mounting bracket, and said end wall of said one connecting means having directed away from said channel a surface directed toward said outer wall of said mounting bracket and situated adjacent a free edge of said rib which projects from said inner surface of said outer wall of said mounting bracket.

10. The combination of claim 8 and wherein the other of said horizontal walls of said channel projecting from the lower edge of that one of said opposed side walls which is distant from said mounting bracket carries an upright wall projecting upwardly from the latter horizontal wall parallel to said channel side wall distant from said mounting bracket and the latter side of said channel and vertical wall projecting upwardly from the other of said horizontal walls respectively having fixed thereto a pair of ribs situated in a common horizontal plane above said other horizontal wall and forming with said vertical wall parallel to the latter side wall of said channel distant from said mounting bracket the other of said connecting means, and a bar of inverted T-shaped cross section having a bottom horizontal wall situated next to said horizontal wall projecting from said lower edge of said side wall of said channel distant from said mounting bracket and beneath the pair of ribs of said other connecting means, said bar having an upright wall adapted to be connected with a building structure and forming the other of the supporting structures cooperating with said other connecting means.

11. The combination of claim 10 and wherein said channel together with said ribs fixed to said opposed side walls thereof and together with said horizontal walls and pair of connecting means are in the form of a single unitary elongated extrusion.

12. The combination of claim 11 and wherein said mounting brackets is in the form of a single elongated unitary extrusion.

13. The combination of claim 12 and wherein said extrusion which includes said channel includes an extension of said horizontal wall projecting from the lower edge of said channel side wall distant from said mounting bracket, said extension extending beyond said vertical wall of said other connecting means and being adapted to support part of a ceiling tile.

14. For use in the support of drapery tracks, Venetian blinds, or the like, an elongated channel having a pair of opposed side walls, which respectively have inner surfaces directed toward each other, and a transverse wall extending between and interconnecting said side walls and forming a top wall from which said side walls extend downwardly when the channel is in an operative position, said channel having an open bottom situated beneath said top wall thereof in said operative position of said channel, and said channel including a plurality of interior ribs extending longitudinally of said channel and fixed to said side walls thereof while extending inwardly from said inner surfaces of said side walls, said ribs at each of said side walls being situated at different elevations when the channel is in said operative position, and said ribs including a plurality of pairs of ribs with the ribs of each pair being respectively situated at said opposed side walls in a common plane, said pairs of ribs including in said operative position of said channel at least two lowermost pairs of ribs, for use in at least the partial support of a drapery track or in the support of blind locks which in turn support one type of Venetian blind, while also including a plurality of pairs of ribs situated higher than said lowermost pairs, closer to said top wall and adapted to be used in connection with another type of Venetian blind, said channel including an additional rib fixed to and extending inwardly from an inner surface of one of said side walls beneath those ribs of said plurality of pairs of ribs which are higher than said lowermost pairs which are fixed to said one side wall and higher than those ribs of said lowermost pairs of ribs which are fixed to said one side wall, and said additional rib at said one side wall cooperating with a lowermost rib at the other of said side walls for supporting a drapery track.

* * * * *